US006035474A

United States Patent [19]

Knibbs

[11] Patent Number: 6,035,474

[45] Date of Patent: Mar. 14, 2000

[54] SANDER WITH DEPTH GUIDE AND PROCESS OF SANDING A SURFACE

[76] Inventor: John Allen Knibbs, 8478 Woodcrest Dr. Apt. 4, Westland, Mich. 48185

[21] Appl. No.: 09/089,325

[22] Filed: Jun. 2, 1998

[51] Int. Cl.[7] ..... B24B 23/02

[52] U.S. Cl. ..... 9/357; 451/344; 451/491; 451/458; 451/520; 451/441

[58] Field of Search ..... 451/488, 344, 451/357, 353, 442, 557–558, 575, 451, 491, 520, 356, 358, 363, 458

[56] References Cited

U.S. PATENT DOCUMENTS 1,653,108 12/1927 Koenig ..... 451/359
3,162,221 12/1964 Lacey ..... 144/134
3,762,452 10/1973 Bernald ..... 144/134 D
3,853,160 12/1974 Posey ..... 144/137
4,156,990 6/1979 Rutkowski ..... 451/358
4,403,457 9/1983 Zerbe ..... 451/359

*Primary Examiner*—Robert A. Rose
*Assistant Examiner*—George Nguyen
*Attorney, Agent, or Firm*—John R. Benefiel

[57] ABSTRACT

A sander is mounted in a cavity in a guide block so as to have an abrasive surface protruding from a bottom surface to a selectively variable extent. The bottom surface of the guide block acts as a depth guide when engaging a flat surface adjacent to a surface to be sanded to establish a step of predetermined height. Either a manual or power sander can be mounted to the guide block. The sander-guide block assembly allows a carrying out process of installing flooring to perfectly match an adjacent floor surface.

9 Claims, 2 Drawing Sheets

SANDER WITH DEPTH GUIDE AND PROCESS OF SANDING A SURFACE

BACKGROUND OF THE INVENTION

This invention concerns sanding tools, and more particularly, sanders such as used in flooring applications. Situations are often encountered where flooring material such as sheet vinyl must be matched to an adjoining existing floor surface. A perfectly flush match is highly desirable, as a mismatched floor will create an edge which tends to catch anything moved along the floor surface, perhaps to trip a person whose shoe catches the edge. The mismatched edge is also quite visible.

The standard technique involves filling the area adjacent the existing floor as with a cement or plaster material. The filler is then carefully sanded to an exact depth matching the thickness of the flooring to be installed. This requires a highly skilled, painstaking effort to sand the filler to the precise depth necessary and is difficult to carry out perfectly.

The object of the present invention is to provide an adjustable depth guide for a sanding tool which makes sanding to the exact depth required much easier than using the manual techniques heretofore employed.

SUMMARY OF THE INVENTION

The above object is achieved by providing a guide block having a cavity recessed into a bottom surface, in which a sander is adjustably positioned so as to position an abrasive surface protruding past the bottom face of the guide block a distance which may be selectively set by a threaded adjustment. The bottom face engages the adjacent floor surface as the sanding of the lower floor progresses to the predetermined depth.

The sander may be supported on a threaded rod so as to be advanced or retracted when the rod is turned to set a particular depth.

The sander can be a block having an abrasive surface on its protruding face for manual sanding, or a power sander can be mounted in the guide block cavity for a power sanding operation.

Edge guides may be mounted on the holder block sides to position the power sander a slight predetermined distance from the floor step to allow a clearance space to accommodate orbital motion of the power sander.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
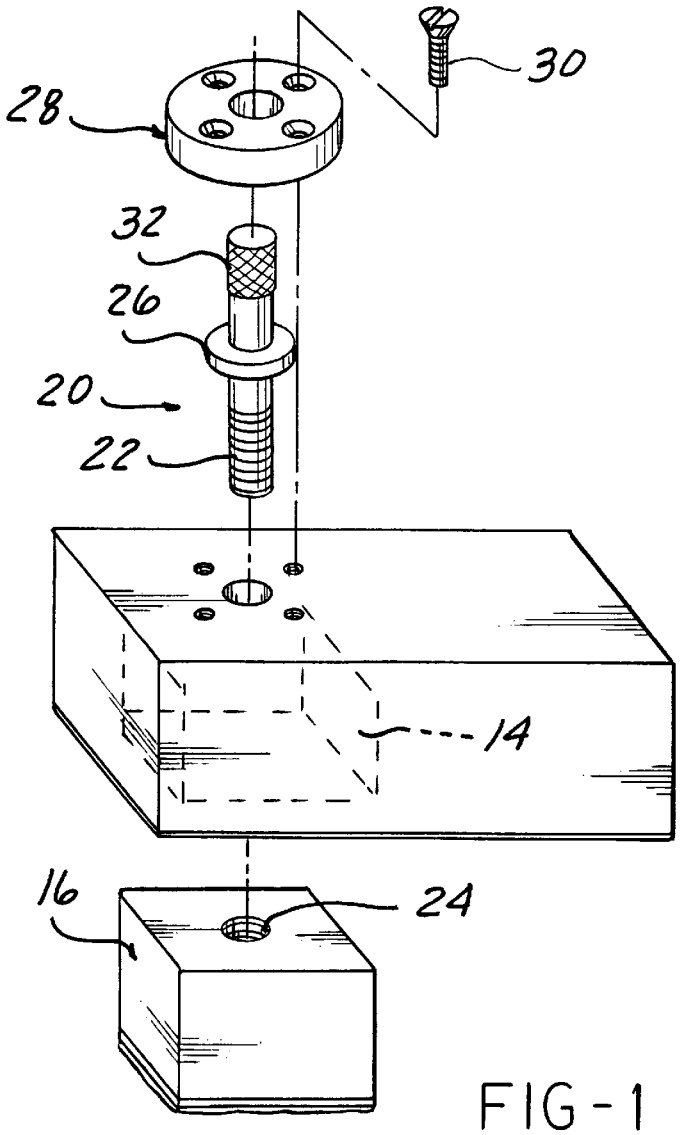
FIG. 1 is an exploded perspective view of a manual sander assembly having a depth guide according to the present invention.
Figure 2:
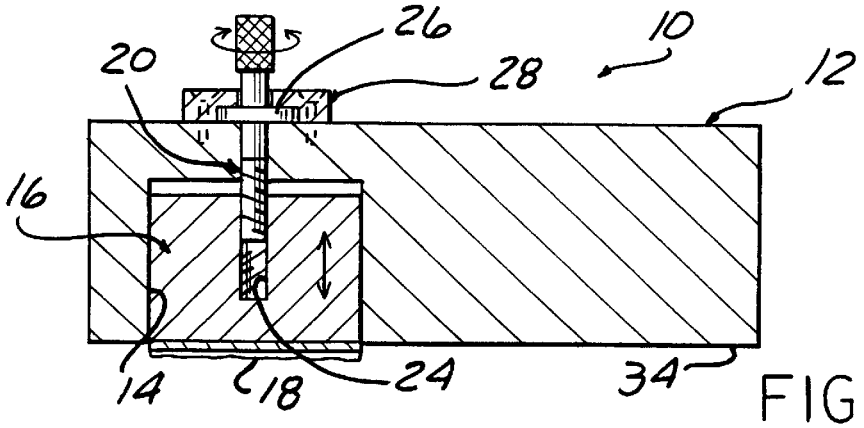
FIG. 2 is a transverse sectional view of the manual sander assembly shown in FIG. 1.

Referring to FIGS. 1 and 2, a manual sander assembly 10 with depth guide according to the present invention is shown. The sander assembly 10 includes a somewhat elongated guide block 12 having a rectangular cavity 14 extending upwardly into the bottom face 34 of the guide block 12. A rectangular sander holder block 16 is fit into the cavity 14 to insure free vertical adjusting movement therein.

The sander holder block 16 has a protruding abrasive face 18 created by a covering of an abrasive material, such as a piece of coarse sandpaper, adhesively attached to the block.

An adjusting rod 20 has a threaded end 22 received in a threaded hole 24 in the top of the holder block 16. A flange 26 is formed intermediate the length of the rod 20 which is captured by a recess in a retainer disc 28 fastened to the top of the guide block 12 with screws 30.

The knurled upper end 32 of the rod 20 facilitates finger rotation of the rod 20 to adjust the vertical position of the block 16. The adjustment is carried out to set a depth relative the bottom surface 34 of the guide block 12.

The guide block 12 may be constructed of a durable low friction plastic such as DELRIN™ to allow low friction rubbing on a floor surface.

Figure 3:
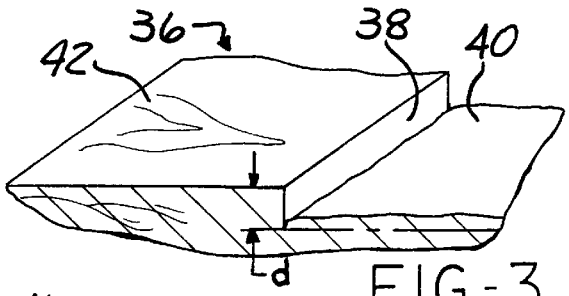
FIG. 3 is a fragmentary perspective view of a floor section at a step to be sanded to a predetermined height.
Figure 4:
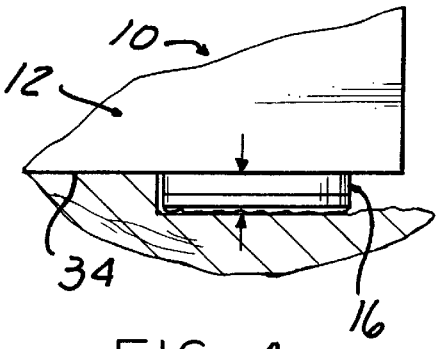
FIG. 4 is a view through the floor section with a fragmentary view of the sander assembly in use.
Figure 5:
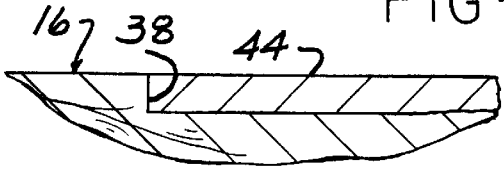
FIG. 5 is a sectional view through the finished floor seam.

FIG. 3 illustrates a floor section 36 having a step 38. A floor covering is to be installed on surface 40 to be flush with surface 42.

A coating of filler material is often applied on surface 40, creating an uneven surface, adjacent the step 38. The protruding depth of the block 16 is set to match the depth d by turning the rod 20.

The guide block 12 bottom surface 34 engages the floor surface 42 after the user has sanded away the surface 40 to a sufficient extent such that the exact desired height of the step 38 is achieved.

One of the straight sides of sander holder block 16 acts as an edge guide engaging the step 38 as the sanding is being conducted.

Thus, when the flooring section 44 is installed a perfectly flush fit is obtained.

Figure 6:
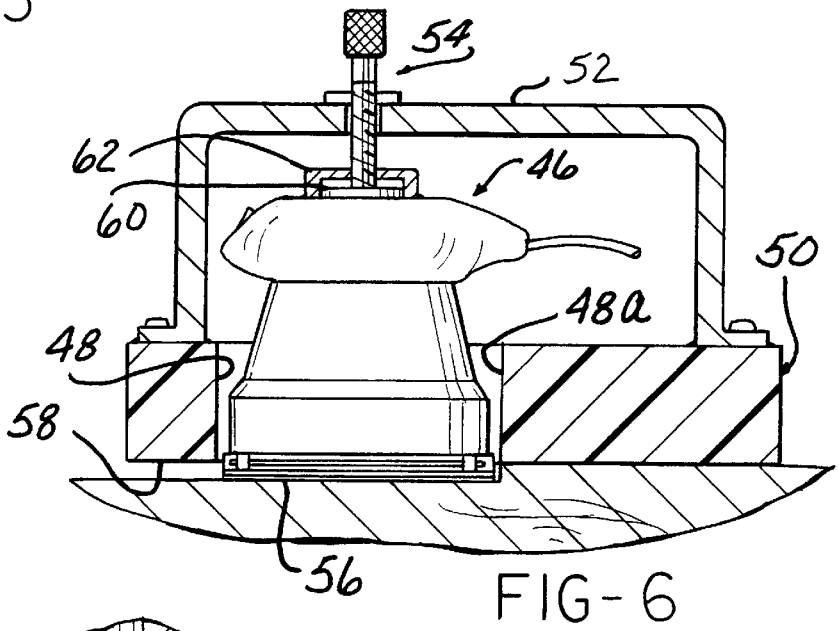
FIG. 6 is a partially sectional view through a floor section and a powered version of the sander assembly with depth guide according to the present invention.
Figure 8:
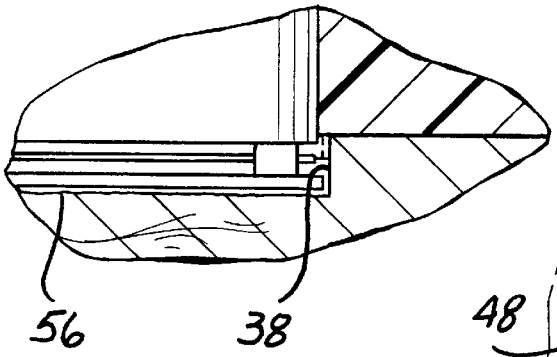
FIG. 8 is a fragmentary enlarged partially sectional view of the floor seam and sander assembly.
Figure 7:
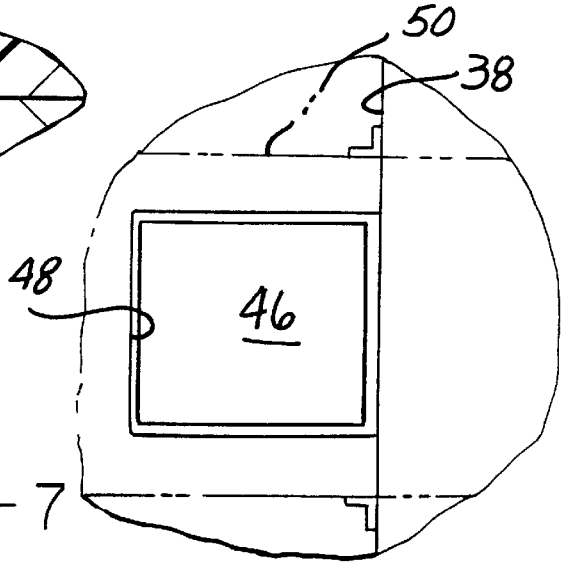
FIG. 7 is a fragmentary plan view of the sander assembly and floor assembly.

This arrangement can also be used with a power sander, as seen in FIGS. 6–8.

A palm grip orbital sander 46 is installed disposed in a through cavity 48 in a guide block 50.

A bridging support bracket 52 attached to the upper side of the guide block 50 receives adjusting rod 54 in a threaded hole to suspend the sander 46 at an adjustable height in the cavity 48 to position the sanding surface 56 at a predetermined distance below the bottom surface 58.

A flange 60 of the rod 54 is captured in a retainer 62 attached to the top of the sander 46.

Since the sander undergoes a slight orbital motion, cavity 48 is large enough to provide a clearance accommodating the orbital motion.

A pair of angle guide pieces 60 are attached to the guide block 50, one on each side aligned with one side 48A of the cavity 48. The guide pieces 60 protrude below the bottom surface 58 a short distance to allow engagement of the floor step 38 for guidance. The orbital motion of the sander 56 thus is accommodated.

What is claimed is:

1. A sander with a depth guide for sanding a surface forming a step of a desired height with an adjacent higher surface comprising:

a sander having a rectangular four sided holder member formed with a flat surface covered with an abrasive material for sanding a flat surface;

a guide block having a flat bottom surface;

a cavity formed into said bottom surface, said cavity having a rectangular configuration corresponding to said sander member and said sander member received therein with said abrasive surface protruding below said guide block bottom surface;

an adjustment element for selectively adjustably positioning said sander in said cavity to cause said abrasive surface to be spaced a variable distance below said bottom surface, said bottom surface engaging said higher surface providing a variable depth guide for said sander;

guide means engaging said step to position one of said holder member four sides to be parallel to and immediately adjacent to said step, whereby said surface can be sanded by moving said sander along said step to establish a desired step depth.

2. The sander according to claim 1 wherein said sander member comprises a rectangular, four sided sander holder block having said abrasive surface thereon.

3. The sander according to claim 1 wherein one of said sander holder block sides is adapted to engage said step to comprise said guide means.

4. The sander according to claim 3 wherein said guide block is elongated having said cavity on one end thereof.

5. The sander according to claim 1 wherein said sander comprises a power sander adjustably suspended in said cavity.

6. The sander according to claim 5 wherein said sander comprises an orbital sander driving said holder member in an orbital motion, said cavity being oversized to accommodate orbital motion of said holder member.

7. The sander according to claim 6 further including a pair of edge guides attached to said guide block protruding below said bottom surface and aligned with one side of said cavity to be engageable with said step in said surface to be sanded to comprise said guide means.

8. A process of sanding a surface separated from a higher adjacent surface by a step so as to establish a predetermined height of said step, comprising the steps of:

supporting a rectangular sander holder member having an abrasive surface in a rectangular cavity in a guide block so as to position said abrasive surface below a flat bottom of said guide block a distance equal to said step predetermined height;

sanding a lower one of said surfaces with said abrasive surface of said sander while holding said bottom surface of said guide block on said higher adjacent floor surface and guiding said sander by engagement of a fixed guide means with said step so that one of said four sides of said sander holder extends parallel to said step until said lower surface is sanded sufficiently to establish said predetermined step height.

9. A sander with a depth guide comprising:

a sander having an abrasive surface for sanding a flat surface;

a guide block having a flat bottom surface;

a cavity formed into said bottom surface, said cavity having a configuration corresponding to said sander and said sander received therein with said abrasive surface protruding below said guide block bottom surface;

an adjustment element for selectively adjustably positioning said sander in said cavity to cause said abrasive surface to be spaced a variable distance below said bottom surface, said adjustment element comprising a threaded rod supporting said sander, and a threaded engagement causing vertical movement of said sander upon rotation thereof;

whereby said bottom surface engaging a higher surface can provide a variable depth guide for said sander engaging a lower surface sanded by said abrasive surface.

* * * * *